US009691529B2

(12) United States Patent
Takahashi et al.

(10) Patent No.: US 9,691,529 B2
(45) Date of Patent: Jun. 27, 2017

(54) COMPOSITE MAGNETIC MATERIAL AND METHOD FOR MANUFACTURING SAME

(71) Applicant: PANASONIC CORPORATION, Osaka (JP)

(72) Inventors: Takeshi Takahashi, Kyoto (JP); Shota Nishio, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 424 days.

(21) Appl. No.: 14/376,811

(22) PCT Filed: Mar. 15, 2013

(86) PCT No.: PCT/JP2013/001753
§ 371 (c)(1),
(2) Date: Aug. 5, 2014

(87) PCT Pub. No.: WO2013/140762
PCT Pub. Date: Sep. 26, 2013

(65) Prior Publication Data

US 2014/0373678 A1 Dec. 25, 2014

(30) Foreign Application Priority Data

Mar. 22, 2012 (JP) ..... 2012-064998

(51) Int. Cl.

| | |
|---|---|
| ***C22C 33/02*** | (2006.01) |
| ***H01F 1/33*** | (2006.01) |
| ***B22F 3/12*** | (2006.01) |
| ***C22C 19/03*** | (2006.01) |
| ***C22C 38/00*** | (2006.01) |
| ***C22C 38/02*** | (2006.01) |
| ***C22C 38/06*** | (2006.01) |
| ***C22C 38/08*** | (2006.01) |
| ***C22C 38/12*** | (2006.01) |
| ***H01F 41/02*** | (2006.01) |
| ***H01F 1/147*** | (2006.01) |

(52) U.S. Cl.

CPC ..... *H01F 1/33* (2013.01); *B22F 3/12* (2013.01); *C22C 19/03* (2013.01); *C22C 33/0228* (2013.01); *C22C 38/00* (2013.01); *C22C 38/02* (2013.01); *C22C 38/06* (2013.01); *C22C 38/08* (2013.01); *C22C 38/12* (2013.01); *H01F 1/14741* (2013.01); *H01F 1/14766* (2013.01); *H01F 1/14791* (2013.01); *H01F 41/02* (2013.01); *H01F 41/0246* (2013.01)

(58) Field of Classification Search

None

See application file for complete search history.

(56) References Cited

U.S. PATENT DOCUMENTS

| | | | | |
|---|---|---|---|---|
| 3,255,052 | A | 6/1966 | Opitz | |
| 5,439,116 | A * | 8/1995 | Van Lierde | B03D 1/002 209/166 |
| 2003/0077448 | A1 | 4/2003 | Ueta et al. | |
| 2011/0024671 | A1 | 2/2011 | Otsuki et al. | |
| 2011/0175013 | A1 | 7/2011 | Takahashi et al. | |
| 2014/0049354 | A1 | 2/2014 | Ye et al. | |

FOREIGN PATENT DOCUMENTS

| | | | |
|---|---|---|---|
| CN | 102007550 | | 4/2011 |
| CN | 102171776 | | 8/2011 |
| EP | 2330602 | A1 | 6/2011 |
| JP | 06-029114 | A | 2/1994 |
| JP | 2003-303711 | A | 10/2003 |
| JP | 2004-217994 | A | 8/2004 |
| JP | 2004-339598 | A | 12/2004 |
| JP | 2008-144278 | * | 6/2008 |
| JP | 2008-144278 | A | 6/2008 |
| JP | 2014-515880 | | 7/2014 |
| WO | 2009/128427 | A1 | 10/2009 |
| WO | 2010/038441 | A1 | 4/2010 |
| WO | 2010/074627 | A1 | 7/2010 |
| WO | 2012/136758 | | 10/2012 |

OTHER PUBLICATIONS

The Extended European Search Report dated Feb. 13, 2015 for the related European Patent Application No. 13763567.8.

English Translation of Chinese Search Report dated Jul. 19, 2016 for the related Chinese Patent Application No. 201380015615.5.

Communication pursuant to Article 94(3) EPC dated Jan. 25, 2017 for the related European Patent Application No. 13763567.8.

M.W. Chaudhari, "Inclusions in Muscovite of Iron Oxides and Hydroxides", XP055334978, Accepted for publication Dec. 1969, Printed Jun. 1970.

Shin Tajima et al., "Magnetic Properties and Microstructure of High-Density Sintered Iron Formed by Warm Compaction Using Die Wall Lubrication", XP055335381, Materials Transactions, vol. 46, No. 6, (2005) pp. 1402-1406.

International Search Report issued in International Application No. PCT/JP2013/001753 with Date of mailing Apr. 16, 2013, with English Translation.

* cited by examiner

*Primary Examiner* — Jessee Roe
*Assistant Examiner* — Ngoclan T Mai
(74) *Attorney, Agent, or Firm* — McDermott Will & Emery LLP

(57) ABSTRACT

A composite magnetic material contains metal magnetic powder composed of metal magnetic particles, and mica interposed between the metal magnetic particles as an inorganic insulator. The mica has an Fe content of 15 wt % or less per 100 wt % of the mica in terms of $Fe_2O_3$. To manufacture the composite magnetic material, first, mixed powder is prepared by mixing the metal magnetic powder and the mica so as to be dispersed into each other. Next, a compact is formed by pressure-molding the mixed powder. Finally, the compact is heat-treated.

5 Claims, No Drawings

COMPOSITE MAGNETIC MATERIAL AND METHOD FOR MANUFACTURING SAME

RELATED APPLICATIONS

This application is a national phase of International Application No. PCT/JP2013/001753, filed on Mar. 15, 2013, which in turn claims the benefit of Japanese Application No. 2012-064998, filed on Mar. 22, 2012, the disclosures of which Applications are incorporated by reference herein.

TECHNICAL FIELD

The present invention relates to a composite magnetic material used in electronic devices such as inductors, choke coils, and transformers, and a method for manufacturing the composite magnetic material.

BACKGROUND ART

With the recent downsizing of electrical and electronic devices, inductor components including magnetic materials are also demanded to be smaller and more efficient. For example, a choke coil, which is an inductor component used in a high-frequency circuit, includes either a ferrite magnetic core made of ferrite powder or a composite magnetic material (a compressed powder magnetic core). The composite magnetic material is a compact of metal magnetic powder.

The ferrite magnetic core has disadvantages of low saturation magnetic flux density and low DC superimposing characteristics. Therefore, in order to ensure sufficient DC superimposing characteristics, conventional ferrite magnetic cores are provided with a gap of several hundreds of micrometers in a direction perpendicular to the magnetic path, thereby keeping the inductance L at DC superimposition. However, such a large gap causes a beat note, and also a leakage magnetic flux particularly in high-frequency ranges, thereby causing serious copper loss in the copper windings.

In contrast, the composite magnetic material, which is manufactured by molding metal magnetic powder, is advantageous for use in small devices because its saturation magnetic flux density is far greater than that of the ferrite magnetic core. Unlike the ferrite magnetic core, the composite magnetic material can be used without forming a gap, thereby having small beat note and low copper loss caused by the leakage magnetic flux.

The composite magnetic material, however, cannot be said to be superior to the ferrite magnetic core in terms of magnetic permeability and core loss. In particular, when used in a choke coil or an inductor, the composite magnetic material has large core loss, and hence, the core is likely to rise in temperature. For this reason, it is difficult to downsize inductor components containing the composite magnetic material. Furthermore, the composite magnetic material must have a large mold density in order to have high magnetic properties. The molding pressure required is not less than 6 ton/cm$^2$, or is not less than 10 ton/cm$^2$ depending on the product.

The core loss of a composite magnetic material is usually composed of an eddy current loss and a hysteresis loss. In general, metal magnetic powder has low intrinsic resistivity. Therefore, if the magnetic field changes, an eddy current flows so as to reduce this change, thus raising the problem of eddy current loss. The eddy current loss increases as the square of the frequency and the square of the area where the eddy current flows. The area where the eddy current flows can be reduced from the entire core containing the metal magnetic particles to only within the metal magnetic particles by coating the surface of the metal magnetic particles composing the metal magnetic powder with an insulating material. As a result, the eddy current loss can be reduced.

In addition, as the composite magnetic material is molded under high pressure, a large number of process strains are introduced into the compact. The composite magnetic material is thus decreased in the magnetic permeability and is increased in the hysteresis loss. To avoid this problem, after being molded, the compact is heat-treated to relax the strains, if necessary. In general, the relaxation of the strains introduced into the metal magnetic powder occurs at a heat-treatment temperature that is at least half the melting point. In order to sufficiently relax the strains in Fe-rich alloy, the compact must be heat-treated at 600° C. or more, and preferably at 700° C. or more. In other words, in the case of using the composite magnetic material, it is essential to heat-treat the compact at a high temperature while the insulation between the metal magnetic particles is maintained.

Examples of the insulating binder used in the composite magnetic material include epoxy resin, phenol resin, and vinyl chloride resin. These organic resins, however, have low heat resistance and are thermally decomposed if the compact is heat-treated at high temperature to relax the strains. For this reason, these insulating binders cannot be used.

To overcome this problem, the use of polysiloxane resin has been proposed (PLT 1, for example).

CITATION LIST

Patent Literature

PLT 1: Japanese Unexamined Patent Publication No. H06-29114

SUMMARY OF THE INVENTION

The present invention is a composite magnetic material that can be heat-treated at a high temperature and has excellent magnetic properties, and a method for manufacturing the composite magnetic material. The composite magnetic material of the present invention contains metal magnetic powder composed of metal magnetic particles, and mica interposed as an inorganic insulator between the metal magnetic particles. The mica has an Fe content of 15 wt % or less per 100 wt % of the mica in terms of $Fe_2O_3$. The method for manufacturing a composite magnetic material of the present invention includes the following steps. First, mixed powder is prepared by mixing the metal magnetic powder with mica so as to be dispersed into each other. Next, a compact is formed by pressure-molding the mixed powder. Then, the compact is heat-treated. The mica has an Fe content of 15 wt % or less per 100 wt % of the mica in terms of $Fe_2O_3$.

In the composite magnetic material of the present invention, the mica is interposed as an inorganic insulator with excellent heat resistance between the metal magnetic particles. This configuration prevents the metal magnetic particles from reacting with each other in a high-temperature heat treatment. In the case that the Fe content of the mica is 15 wt % or less in terms of $Fe_2O_3$, the composite magnetic material has excellent magnetic properties, while ensuring the insulation between the metal magnetic particles.

DESCRIPTION OF EMBODIMENT

The use of polysiloxane resin allows the insulating material used for insulation between the metal magnetic particles to be slightly more heat resistant than the use of organic resin such as epoxy resin or phenol resin. However, even with the use of polysiloxane resin, the heatproof temperature of the compact is 500 to 600° C., and it is difficult to perform heat treatment at temperatures exceeding this range.

Hereinafter, the composite magnetic material of an embodiment of the present invention will be described. The composite magnetic material of the present embodiment contains metal magnetic powder composed of metal magnetic particles, and mica interposed as an inorganic insulator between the metal magnetic particles.

Mica is classified into mineral mica as a natural resource and synthetic mica produced through a solid phase reaction synthesis or a melting synthesis. Examples of the mineral mica include muscovite, phlogopite, and biotite, whereas examples of the synthetic mica include tetrasilicic fluormica and fluorphlogopite. In the present embodiment, any of these micas can be used.

Mica is highly heat resistant. Therefore, when interposed between metal magnetic particles, mica can prevent the metal magnetic particles from reacting with each other even during a high-temperature heat treatment.

The mica has an Fe content of 15 wt % or less in terms of $Fe_2O_3$. Since Fe can be either divalent or trivalent, it may cause hopping conduction. Limiting the Fe content of the mica to 15 wt % or less in terms of $Fe_2O_3$ can reduce the electronic conductivity due to the above cause, thereby improving the insulation of the mica itself.

Although for the reason is unknown, the addition of Fe to mica decreases the hardness of mica itself and improves its deformability. This increases the density of the composite magnetic material after being pressure-molded. Therefore, it is preferable that the mica contain trace amounts of Fe. More specifically, it is preferable that the Fe content of the mica be within the range from 0.5 wt % to 15 wt %, inclusive, in terms of $Fe_2O_3$. This allows the composite magnetic material to have excellent magnetic properties.

It is also preferable that the mica be composed of flat-particle powder. In the case of using mica composed of flat-particle powder, the insulation between the metal magnetic particles can be higher than in the case of using mica composed of spherical-particle powder. This can reduce the amount of mica to be added, and hence, increase the filling factor of the metal magnetic powder in the composite magnetic material, thereby improving the magnetic properties of the composite magnetic material. It is preferable that the mica particles have an aspect ratio of 4 or more.

In the case that the average length of the long axes of flat particles of the mica is too smaller than the average particle size of the metal magnetic particles, the insulation between the metal magnetic particles is too low to obtain the above-described insulation effect due to the flat particles. In this case, a larger amount of mica needs to be added, which decreases the filling factor of the metal magnetic powder in the composite magnetic material, and hence, decreases the magnetic properties of the composite magnetic material. In the case that the average length of the long axes of the flat particles of the mica is too larger than the average particle size of the metal magnetic particles, some of the metal magnetic particles contact with each other, failing to ensure high electrical insulation between the metal magnetic particles, thereby increasing the eddy current loss. Hence, the preferable average length of the long axes of the flat particles of the mica is 0.02 to 1.5 times the average particle size of the metal magnetic particles.

The amount of mica to be added is preferably within the range from 0.1 parts to 5 parts, inclusive, by weight per 100 parts by weight of the metal magnetic powder. The amount of mica within this range ensures the electrical insulation between the metal magnetic particles and also provides a high filling factor of the metal magnetic powder in the compact (for example, the compressed powder magnetic core) of the composite magnetic material. As a result, the composite magnetic material has high magnetic properties.

In the present embodiment, the metal magnetic powder contains at least Fe, and is preferably composed of at least one selected from the group consisting of Fe, Fe—Si alloy, Fe—Ni alloy, and Fe—Si—Al alloy.

The Si content of the Fe—Si alloy is preferably within the range from 1 wt % to 8 wt %, inclusive, and the remainder is composed of Fe and unavoidable impurities. When the Si content is 1 wt % or more, the magnetic properties are large, and when it is 8 wt % or less, the saturation magnetic flux density is high, thereby suppressing a decrease in the DC superimposing characteristics.

In the case that the Si content is within the above range, the composite magnetic material has high magnetic properties and a low magnetic anisotropy and a low magnetostriction constant. Si reacts with oxygen and forms Si oxide having a micro thickness on the surface of the metal magnetic particles. This increases the electrical insulation between the metal magnetic particles, thereby reducing the eddy current loss.

The Ni content of the Fe—Ni alloy is preferably within the range from 40 wt % to 90 wt %, inclusive, and the remainder is composed of Fe and unavoidable impurities. When the Ni content is 40 wt % or more, the magnetic properties are large, and when it is 90 wt % or less, the saturation magnetic flux density is high, thereby suppressing a decrease in the DC superimposing characteristics. Furthermore, it is possible to add 1 wt % to 6 wt % of Mo to increase the magnetic permeability.

In the Fe—Si—Al alloy, the Si content is preferably within the range from 6 wt % to 10 wt %, inclusive, and the Al content is preferably within the range from 5 wt % to 9 wt %, inclusive, and the remainder is composed of Fe and unavoidable impurities. In the case that the amounts of Si and Al are within the above composition ranges, the composite magnetic material has high soft magnetic properties, and high saturation magnetic flux density, thereby suppressing a decrease in the DC superimposing characteristics.

Among the above-mentioned various metal magnetic powders, the one composed of the Fe—Si—Al alloy is most preferable because of having the lowest loss and high total soft magnetic properties.

It is preferable that the metal magnetic particles have an average particle size within the range from 1 μm to 100 μm, inclusive. When the average particle size is 1 μm or more, the composite magnetic material has high mold density and high magnetic properties. When the average particle size is 100 μm or less, the composite magnetic material has low eddy current loss in high-frequency ranges. The average particle size is more preferably 50 μm or less. The average particle size of the metal magnetic particles can be measured using laser diffraction particle size analysis. According to this analysis, when the measured particles have the same ray diffraction/scattering pattern as a 10 μm-diameter sphere, the particle size is defined as 10 μm regardless of the shape of the particles.

In the case that the metal magnetic particles are flat- or scaly-shaped with a large surface area, the particles come into contact with each other, causing an increase in the eddy current loss. To avoid this problem, the metal magnetic particles are preferably spherical with an aspect ratio in the range from 1 to 3, and more preferably in the range from 1 to 2. The compact formed by pressure-molding the spherical metal magnetic particles has high mold density and the shape contributes to magnetic permeability.

The method for manufacturing the metal magnetic powder is not particularly limited; various atomizing methods and various kinds of pulverized powders can be used.

The method for manufacturing the composite magnetic material of the present embodiment will be described hereinafter. First, metal magnetic powder and an inorganic insulator are mixed so as to be dispersed into each other to prepare mixed powder. The devices and methods to be used in the dispersion process are not particularly limited. For example, it is possible to use a ball mill such as a rotary ball mill or a planetary ball mill, a V-blender or a planetary mixer.

Next, the mixed powder is mixed with a bonding material to prepare granular powder. The devices and methods to be used in the granulation process are not particularly limited; for example, the above-mentioned methods to be used for the mixing and dispersion of the metal magnetic powder and the inorganic insulator can be used. Furthermore, the bonding material can be added when the metal magnetic powder and the inorganic insulator are mixed so as to be dispersed into each other. Note that the granulation process is not essential.

Examples of the bonding material include coupling agents based on silane, titanium, chromium, and aluminum, and resins such as silicone resin, epoxy resin, acrylic resin, butyral resin, and phenol resin. Preferable among them are coupling agents based on silane, titanium, chromium, and aluminum, and silicone resin. Using them allows their oxides to remain in the composite magnetic material after the high-temperature heat treatment.

The remaining oxides play a role in bonding the metal magnetic particles and the inorganic insulator, thereby increasing the mechanical strength of the composite magnetic material after the high-temperature heat treatment. As long as the mechanical strength of the composite magnetic material is sufficiently ensured, it is possible to add epoxy resin, acrylic resin, butyral resin, phenol resin or the like, together with the bonding material.

Next, the above-mentioned granular powder is pressure-molded to form a compact. The molding method in the pressure-molding process is not particularly limited; any common pressure-molding method can be used. It is preferable that the molding pressure be within the range from 6 to 20 ton/cm$^2$, inclusive. If the molding pressure is less than 6 ton/cm$^2$, the filling factor of the metal magnetic powder is low, making it impossible to obtain high magnetic properties. If the pressure is more than 20 ton/cm$^2$, on the other hand, a large mold is required to ensure the mechanical strength at the time of pressure molding. This decreases the productivity, leading to a cost increase in the product.

Next, the compact is heat-treated. In the heat-treatment process, the process strains introduced into the metal magnetic powder at the time of pressure molding are relaxed, thereby restoring the original magnetic properties. The higher the heat-treatment temperature, the better because more process strains can be relaxed. However, too high a temperature causes the metal magnetic particles to sinter together, providing insufficient insulation between the metal magnetic particles, thereby increasing the eddy current loss. Hence, it is preferable that the heat-treatment temperature be within the range from 700° C. to 1000° C., inclusive. The heat treatment within this temperature range can sufficiently relax the process strains, allowing the compact to have high magnetic properties and low eddy current loss.

It is preferable that the heat-treatment process be performed in a non-oxidizing atmosphere, which suppresses a decrease in the soft magnetic properties caused by the oxidation of the metal magnetic powder. Examples of the atmosphere to perform the heat treatment of the compact include an inert atmosphere using, for example, argon gas, nitrogen gas, or helium gas; a reducing atmosphere using, for example, hydrogen gas; and a vacuum atmosphere.

Hereinafter, the composite magnetic material of the present embodiment will be described in detail using Examples.

Samples of the composite magnetic material are prepared using Fe—Si—Al magnetic powder as the metal magnetic powder and mica as the inorganic insulator. The measurement results of the magnetic properties will be described with reference to Table 1.

In Samples Nos. 1 to 11 shown in Table 1, the metal magnetic powder has a composition of 8.9 wt % Si, 5.4 wt % Al, and the remainder composed of Fe and unavoidable impurities. The average particle size of the metal magnetic powder is 22 μm. The micas used as the inorganic insulator have an aspect ratio of 30. The average length of the long axes of the mica particles is 15 μm. The other data are as shown in Table 1. In Samples Nos. 1 to 11, the Fe contents of the micas are different form each other. The amount of mica added is 1.2 parts by weight per 100 parts by weight of the metal magnetic powder. First, the above-mentioned metal magnetic powder is mixed with the respective micas to prepare respective mixed powders.

Then, 1.0 part by weight of silicone resin is added as the bonding material to 100 parts by weight of the obtained respective mixed powders, and then a small amount of toluene is added thereto. The resulting mixtures are each kneaded to prepare respective granular powders. These granular powders are pressure-molded at a molding pressure of 11 ton/cm$^2$, and then heat-treated for 1 h at 850° C. under an argon atmosphere. As a result, samples are completed which are toroidal cores having an outer diameter of 14 mm, an inner diameter of 10 mm, and a height of about 2 mm.

The completed samples are evaluated for DC superimposing characteristics and core loss. The DC superimposing characteristics are evaluated by measuring the magnetic permeability at an applied magnetic field of 54 Oe and a frequency of 110 kHz using an LCR meter. The core loss is evaluated at a measuring frequency of 120 kHz and a measuring magnetic flux density of 0.1 T using an AC B-H curve tracer. The Fe content of each mica is measured using ICP emission spectrometry. The measurement results are shown in Table 1.

TABLE 1

| sample No | inorganic insulator | Fe content (wt %) (in terms of $Fe_2O_3$) | magnetic permeability | core loss ($kW/m^3$) | remarks |
|---|---|---|---|---|---|
| 1 | fluorphlogopite | 0 | 50 | 429 | synthetic |
| 2 | muscovite | 0.2 | 51 | 407 | mineral |
| 3 | tetrasilicic fluormica | 0.4 | 53 | 396 | synthetic |
| 4 | muscovite | 0.5 | 60 | 240 | mineral |
| 5 | phlogopite | 1 | 62 | 209 | mineral |
| 6 | phlogopite | 4 | 63 | 204 | mineral |
| 7 | biotite | 8 | 61 | 226 | mineral |
| 8 | fluorphlogopite | 12 | 58 | 308 | synthetic |
| 9 | tetrasilicic fluormica | 15 | 56 | 330 | synthetic |
| 10 | tetrasilicic fluormica | 16 | 41 | 627 | synthetic |
| 11 | fluorphlogopite | 20 | 32 | 980 | synthetic |

The results in Table 1 indicate that the toroidal cores of Samples Nos. 1 to 9 in which each of the micas has an Fe content of 15 wt % or less in terms of $Fe_2O_3$ have much higher magnetic permeability and much lower core loss than the toroidal cores in Samples Nos. 10 and 11. The mica in Samples No. 10 has an Fe content of 16 wt % and the mica in Sample No. 11 has an Fe content of 20 wt % both in terms of $Fe_2O_3$.

A comparison between Samples Nos. 1 to 3 and Samples Nos. 4 to 9 indicate that the magnetic permeability is high and the core loss is low in the case that the Fe content is within the range from 0.5 wt % to 15 wt %, inclusive, in terms of $Fe_2O_3$.

Next, samples of the composite magnetic material are prepared using Fe—Ni magnetic powder as the metal magnetic powder and mica as the inorganic insulator. The measurement results of the magnetic properties will be described as follows.

In Samples Nos. 12 to 21 shown in Table 2, the metal magnetic powder has a composition of 49 wt % Ni and the remainder composed of Fe and unavoidable impurities. The average particle size of the metal magnetic powder is 16 μm. The micas have an aspect ratio of 20. The average length of the long axes of the mica particles is 10 μm. The micas used in this case are fluorphlogopite. The other data are shown in Table 2. In Samples Nos. 12 to 21, the Fe contents of the micas are different from each other. The amount of mica added is 1.0 part by weight per 100 parts by weight of the metal magnetic powder. First, the above-mentioned metal magnetic powder is mixed with the respective micas to prepare respective mixed powders.

Then, 0.7 parts by weight of titanium-based coupling agent and 0.6 parts by weight of butyral resin are added to 100 parts by weight of the obtained respective mixed powders, and then a small amount of ethanol is added thereto. The resulting mixtures are each kneaded to prepare respective granular powders. These granular powders are pressure-molded at 9 $ton/cm^2$, and then heat-treated for 0.5 h at 780° C. under a nitrogen atmosphere. The completed samples are toroidal cores having the same dimensions as those in the previous samples.

The completed samples are evaluated for DC superimposing characteristics and core loss. The DC superimposing characteristics are evaluated by measuring the magnetic permeability at an applied magnetic field of 50 Oe and a frequency of 120 kHz using an LCR meter. The core loss is evaluated at a measuring frequency of 110 kHz and a measuring magnetic flux density of 0.1 T using an AC B-H curve tracer. The Fe content of each mica is measured using ICP emission spectrometry. The measurement results are shown in Table 2.

TABLE 2

| Sample No. | Fe content (wt %) (in terms of $Fe_2O_3$) | magnetic permeability | core loss ($kW/m^3$) |
|---|---|---|---|
| 12 | 0 | 59 | 690 |
| 13 | 0.1 | 60 | 685 |
| 14 | 0.4 | 64 | 670 |
| 15 | 0.5 | 70 | 590 |
| 16 | 3 | 72 | 595 |
| 17 | 9 | 71 | 605 |
| 18 | 11 | 70 | 620 |
| 19 | 15 | 69 | 625 |
| 20 | 16 | 49 | 790 |
| 21 | 19 | 42 | 1100 |

The results in Table 2 indicate that the toroidal cores of Samples Nos. 12 to 19 in which each of the micas has an Fe content of 15 wt % or less in terms of $Fe_2O_3$ have much higher magnetic permeability and much lower core loss than the toroidal cores in Samples Nos. 20 and 21. The mica in Sample No. 20 has an Fe content of 16 wt % and the mica in Sample No. 21 has an Fe content of 19 wt %, both in terms of $Fe_2O_3$.

A comparison between Samples Nos. 12 to 14 and Samples Nos. 15 to 19 indicate that the magnetic permeability is high and the core loss is low in the case that the Fe content is within the range from 0.5 wt % to 15 wt %, inclusive, in terms of $Fe_2O_3$.

Next, samples of the composite magnetic material are prepared using Fe—Si magnetic powder as the metal magnetic powder and mica as the inorganic insulator. The measurement results of the magnetic properties will be described as follows.

In Samples Nos. 22 to 31 shown in Table 3, the metal magnetic powder has a composition of 5.1 wt % Si and the remainder composed of Fe and unavoidable impurities. The average particle size of the metal magnetic powder is 19 μm. The micas have an aspect ratio of 6. The average length of the long axes of the mica particles is 5 μm. The micas used in this case are tetrasilicic fluormica. The other data are shown in Table 3. In Samples Nos. 22 to 31, the Fe contents of the micas are different from each other. The amount of mica added is 2.0 parts by weight per 100 parts by weight of the metal magnetic powder. First, the above-mentioned metal magnetic powder is mixed with the respective micas to prepare respective mixed powders.

Then, 1.5 parts by weight of acrylic resin is added to 100 parts by weight of the obtained respective mixed powders, and then a small amount of toluene is added thereto. The resulting mixtures are each kneaded to prepare respective granular powders. These granular powders are pressure-molded at 16 ton/cm$^2$, and then heat-treated for 1.0 h at 900° C. under an argon atmosphere. The completed samples are toroidal cores having the same dimensions as those in the previous samples.

The completed samples are evaluated for DC superimposing characteristics and core loss. The DC superimposing characteristics are evaluated by measuring the magnetic permeability at an applied magnetic field of 52 Oe and a frequency of 120 kHz using an LCR meter. The core loss is evaluated at a measuring frequency of 110 kHz and a measuring magnetic flux density of 0.1 T using an AC B-H curve tracer. The Fe content of each mica is measured using ICP emission spectrometry. The measurement results are shown in Table 3.

TABLE 3

| Sample No. | Fe content (wt %) (in terms of $Fe_2O_3$) | magnetic permeability | core loss (kW/m$^3$) |
|---|---|---|---|
| 22 | 0 | 56 | 1550 |
| 23 | 0.1 | 57 | 1540 |
| 24 | 0.4 | 60 | 1460 |
| 25 | 0.5 | 69 | 1305 |
| 26 | 2 | 73 | 1260 |
| 27 | 5 | 75 | 1250 |
| 28 | 9 | 74 | 1300 |
| 29 | 15 | 71 | 1370 |
| 30 | 16 | 50 | 1690 |
| 31 | 25 | 46 | 2050 |

The results in Table 3 indicate that the toroidal cores of Samples Nos. 22 to 29 in which each of the micas has an Fe content of 15 wt % or less in terms of $Fe_2O_3$ have much higher magnetic permeability and much lower core loss than the toroidal cores in Samples Nos. 30 and 31. The mica in Sample No. 30 has an Fe content of 16 wt % and the mica in Sample No. 31 has an Fe content of 25 wt %, both in terms of $Fe_2O_3$.

A comparison between Samples Nos. 22 to 24 and Samples Nos. 25 to 29 indicate that the magnetic permeability is high and the core loss is low in the case that the Fe content is within the range from 0.5 wt % to 15 wt %, inclusive, in terms of $Fe_2O_3$.

As understood from above, the composite magnetic material of the present embodiment has excellent magnetic properties because the mica has an Fe content of 15 wt % or less in terms of $Fe_2O_3$. The Fe content of the mica is more preferably within the range from 0.5 wt % to 15 wt %, inclusive, in terms of $Fe_2O_3$.

The measurement results in Table 1 indicate that in the case of using the Fe—Si—Al magnetic powder, it is more preferable that the Fe content of the mica be within the range from 0.5 wt % to 8 wt %, inclusive, in terms of $Fe_2O_3$. The measurement results in Tables 2 and 3 indicate that in the case of using the Fe—Ni magnetic powder and the Fe—Si magnetic powder, respectively, it is more preferable that the Fe content of the mica be within the range from 0.5 wt % to 9 wt %, inclusive, in terms of $Fe_2O_3$. Thus, in the case of using any of the above-mentioned three kinds of metal magnetic powders, it is more preferable that the Fe content of the mica be within the range from 0.5 wt % to 8 wt %, inclusive, in terms of $Fe_2O_3$.

Next, samples of the composite magnetic material that are different from each other in molding pressure are prepared using Fe powder as the metal magnetic powder and mica as the inorganic insulator. The measurement results of the magnetic properties will be described as follows.

In Samples Nos. 32 to 37 shown in Table 4, the metal magnetic powder is Fe powder having an average particle size of 10 μm. The mica has an aspect ratio of 20. The average length of the long axes of the mica particles is 8 μm. The mica used in this case is fluorphlogopite. The Fe content of the mica measured using ICP emission spectrometry is 4 wt % in terms of $Fe_2O_3$. The amount of mica added is 3.0 parts by weight per 100 parts by weight of the metal magnetic powder. First, the above-mentioned metal magnetic powder is mixed with the mica to prepare mixed powder.

Then, 2.0 parts by weight of silicone resin is added to 100 parts by weight of the obtained mixed powder, and then a small amount of toluene is added thereto. The resulting mixture is kneaded to prepare respective granular powders. These granular powders are pressure-molded at the respective molding pressures shown in Table 4, and then heat-treated for 1.5 h at 750° C. under an argon atmosphere. The completed samples are toroidal cores having the same dimensions as those in the previous samples.

The completed samples are evaluated for DC superimposing characteristics and core loss. The DC superimposing characteristics are evaluated by measuring the magnetic permeability at an applied magnetic field of 50 Oe and a frequency of 150 kHz using an LCR meter. The core loss is evaluated at a measuring frequency of 100 kHz and a measuring magnetic flux density of 0.1 T using an AC B-H curve tracer. The measurement results are shown in Table 4.

TABLE 4

| Sample No. | molding pressure (ton/cm$^2$) | magnetic permeability | core loss (kW/m$^3$) |
|---|---|---|---|
| 32 | 5 | 42 | 2900 |
| 33 | 6 | 59 | 2090 |
| 34 | 8 | 69 | 1980 |
| 35 | 10 | 70 | 1950 |
| 36 | 15 | 73 | 1940 |
| 37 | 20 | 75 | 1930 |

The results in Table 4 indicate that the toroidal cores of Samples Nos. 33 to 37 prepared at molding pressures of 6 ton/cm$^2$ or more have high magnetic permeability and low core loss.

Next, samples of the composite magnetic material that are different from each other in heat-treatment temperature are prepared using Fe—Ni—Mo magnetic powder as the metal magnetic powder and mica as the inorganic insulator. The measurement results of the magnetic properties will be described as follows.

In Samples Nos. 38 to 45 shown in Table 5, the metal magnetic powder has a composition of 78 wt % Ni, 4.3 wt % Mo, and the remainder composed of Fe and unavoidable impurities. The average particle size of the metal magnetic powder is 18 μm. The mica has an aspect ratio of 35. The average length of the long axes of the mica particles is 11 μm. The mica used in this case is fluorphlogopite. The Fe content of the mica measured using ICP emission spectrometry is 3 wt % in terms of $Fe_2O_3$. The amount of mica added is 2.5 parts by weight per 100 parts by weight of the metal magnetic powder. First, the above-mentioned metal magnetic powder is mixed with the mica to prepare mixed powder.

Then, 1.0 part by weight of aluminum-based coupling agent and 0.8 parts by weight of butyral resin are added to 100 parts by weight of the obtained mixed powder, and then a small amount of ethanol is added thereto. The resulting mixture is kneaded to prepare respective granular powders. These granular powders are pressure-molded at 8 ton/cm$^2$, and then heat-treated for 0.5 h at the respective temperatures shown in Table 5 under a nitrogen atmosphere. The completed samples are toroidal cores having the same dimensions as those in the previous samples.

The completed samples are evaluated for DC superimposing characteristics and core loss. The DC superimposing characteristics are evaluated by measuring the magnetic permeability at an applied magnetic field of 50 Oe and a frequency of 120 kHz using an LCR meter. The core loss is evaluated at a measuring frequency of 120 kHz and a measuring magnetic flux density of 0.1 T using an AC B-H curve tracer. The measurement results are shown in Table 5.

TABLE 5

| Sample No. | heat-treatment temperature (° C.) | magnetic permeability | core loss (kW/m$^3$) |
|---|---|---|---|
| 38 | 500 | 39 | 990 |
| 39 | 640 | 43 | 580 |
| 40 | 700 | 61 | 400 |
| 41 | 850 | 70 | 260 |
| 42 | 900 | 73 | 300 |
| 43 | 1000 | 59 | 490 |
| 44 | 1050 | 42 | 1200 |
| 45 | 1200 | 34 | 4500 |

The results in Table 5 indicate that the toroidal cores of Samples Nos. 40 to 43 prepared at heat-treatment temperatures within the range from 700° C. to 1000° C., inclusive, have high magnetic permeability and low core loss.

INDUSTRIAL APPLICABILITY

The present invention is useful as a composite magnetic body used in electronic devices such as inductors, choke coils, and transformers in order to provide excellent magnetic properties.

The invention claimed is:

1. A composite magnetic material comprising:

metal magnetic powder composed of metal magnetic particles formed of at least one selected from the group consisting of Fe, Fe—Si alloy, Fe—Ni alloy, Fe—Ni—Mo alloy, and Fe—Si—Al alloy; and mica interposed between the metal magnetic particles, wherein a Fe content of the mica is within a range of 0.5 wt % to 15 wt %, inclusive, per 100 wt % of the mica in terms of $Fe_2O_3$.

2. The composite magnetic material according to claim 1, wherein the metal magnetic powder is composed of the Fe—Si—Al alloy.

3. A method for manufacturing a composite magnetic material, the method comprising:

preparing mixed powder by mixing metal magnetic powder composed of metal magnetic particles with mica so as to be dispersed into each other;

forming a compact by pressure-molding the mixed powder; and heat treating the compact, wherein the metal magnetic powder is formed of at least one selected from the group consisting of Fe, Fe—Si alloy, Fe—Ni alloy, Fe—Ni—Mo alloy, and Fe—Si—Al alloy, and a Fe content of the mica is within a range of 0.5 wt % to 15 wt %, inclusive, per 100 wt % of the mica in terms of $Fe_2O_3$.

4. The method according to claim 3, wherein when forming the compact, the mixed powder is pressed at a molding pressure within a range of 6 ton/cm$^2$ to 20 ton/cm$^2$, inclusive.

5. The method according to claim 3, wherein the compact is heat-treated at a temperature within a range of 700° C. to 1000° C., inclusive, in a non-oxidizing atmosphere.

* * * * *